United States Patent [19]

Nilsson

[11] Patent Number: 4,461,233

[45] Date of Patent: Jul. 24, 1984

[54] RELEASING DEVICE FOR LIFE BOATS AND THE LIKE

[75] Inventor: Per Nilsson, Västra Frölunda, Sweden

[73] Assignee: AB Welin, Sweden

[21] Appl. No.: 372,442

[22] Filed: Apr. 27, 1982

[30] Foreign Application Priority Data

Apr. 29, 1981 [SE] Sweden ..... 8102708

[51] Int. Cl.[3] ..... B63B 23/00

[52] U.S. Cl. ..... 114/378; 114/365; 114/380

[58] Field of Search ..... 114/365, 377, 378, 379, 114/380, 368, 369, 370; 294/83 AB, 84, 83 R

[56] References Cited

U.S. PATENT DOCUMENTS 1,462,422 7/1923 Rinesi ..... 114/365

2,714,731 8/1955 Binmore ..... 114/378

3,811,720 5/1974 Epstein ..... 294/84

*Primary Examiner*—Trygve M. Blix

*Assistant Examiner*—Edwin L. Swinehart

[57] ABSTRACT

A device for releasing a life boat or the like from a hoisting cable, said device comprising a lifting members (13) attached to the boat, a hook (15) being pivotably mounted at said lifting member, said hook being openable by a releasing device. The object of the invention is to provide a releasing device for emergency situations when the normal releasing device is not functioning and which should be releasable even when the full weight of the boat loads the hooks. This has been achieved by the fact that the lifting member (13) is displaceable in its longitudinal direction and that a locking device (29) actuatable by an emergency device is arranged for blocking the lifting member from displacement.

8 Claims, 5 Drawing Figures

12
13
14
15
16
17
19
20
23
24
25
28
31
32
33
34
35
36
37
38
39
40
41
42
43
44
45
IV

RELEASING DEVICE FOR LIFE BOATS AND THE LIKE

BACKGROUND OF THE INVENTION

When life boats are launched it is required that the releasing devices located at the fore and aft of the boat be manually swung to their opening position when the boat has reached the water surface and the load on the lowering tackles has substantially ceased, so that the boat is released. The releasing device comprises a hook and a supporting lifting member, which is fixed to the keel of the boat and which is so designed that the release mechanism cannot be actuated when the boat is hanging in the tackles, i.e. when the hooks are loaded. It has occurred that even after launching the pull in the hoisting cable is so great that the hooks are not manually swingable and a release is not possible. Such a great pull can e.g. exist if the ship still has a speed despite the life boats being launched or if the ship is in strongly streaming water, but also if the ship is sinking fast this situation can occur. Since the hoisting cables usually consists of steel wires and heavy blocks it is not possible to cut oneself loose from the ship by means of an axe or the like.

DISCLOSURE AND ADVANTAGEOUS EFFECTS OF THE INVENTION

The object of the present invention is to provide a releasing device which in an emergency situation can be released if the normal release mechanism is not functioning and said releasing device must be releasable even when the whole weight of the boat loads the hooks. The emergency release should also be secured against involuntary release but should simultaneously be easily actuated. This object has been achieved by the fact that the lifting means is displaceable in its longitudinal direction and that a locking device actuatable by an emergency releasing device is arranged for blocking the lifting means from displacement.

DESCRIPTION OF EMBODIMENTS

Figure 1:
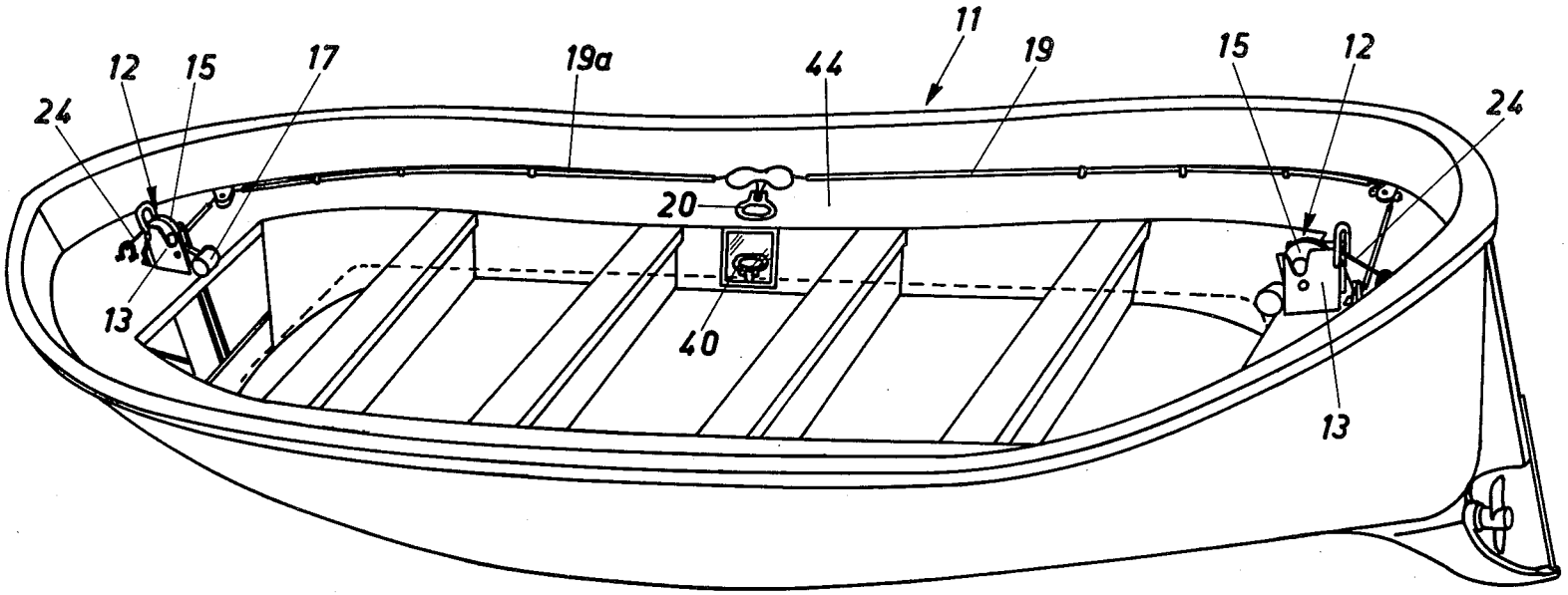
FIG. 1 is a perspective view of a life boat provided with a releasing device according to the invention.

Referring to the drawings the numeral 11 denotes a life boat or the like which at the fore and aft is provided with a releasing device 12 comprising a lifting means 13, the lower portion of which is connected to a bracket 14 attached to the keel of the boat and the upper portion of which is yoke formed and provided with a hook 15 pivotably mounted in the lifting means and which in closed position closes the opening of the yoke. The hook 15 is further provided with a weight 17, which is measured so that the hook is always in closed position. Diametrically opposed to the weight there is attached a loop 18 to the hook, a wire 19 being connected to said loop, said wire being connected to a release handle 20 by way of pulley wheels. A corresponding wire **19*a*** from the other releasing device at the other end of the boat is also connected to said release handle.

So far the construction corresponds to conventional releasing devices, at which the lower end of the lifting means 13 is directly connected and fixed to the bracket 14. Since a full-loaded lift boat can weigh from 5 to 20 tons the load on the hook 15 is very heavy as long as the boat hangs in the hooks. It is therefore impossible and not desirable that the releasing device 20 can open the hooks as long as they are loaded. In order to provide a release in an emergency situation even when the whole weight of the boat acts upon the hooks an emergency releasing device 21 has been provided according to the invention. This differs from releasing devices previously known by the fact that the lifting means 13 is displaceable in its longitudinal direction and that the hook 15 is held by a blocking means 24 in the blocked position shown in FIG. 2, so that when the lifting means is axially displaced the hook 15 is pivoted about the axle 16 and opens.

Figure 2:
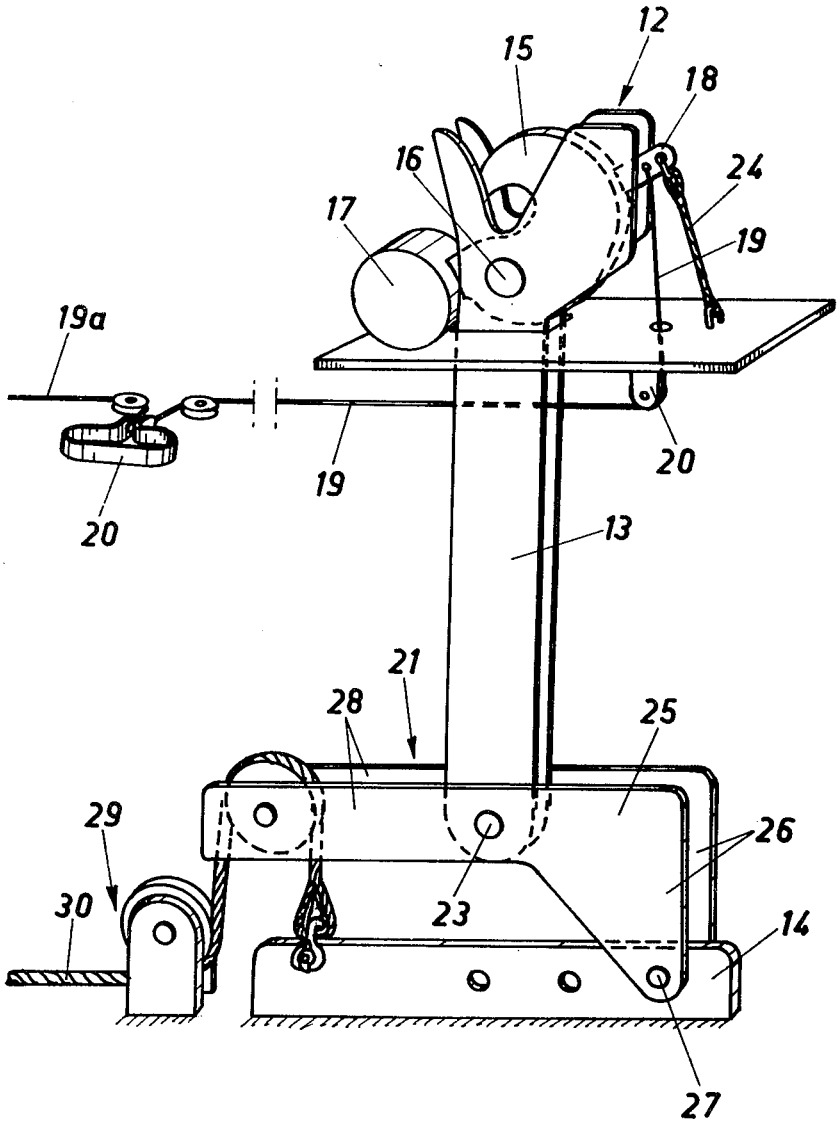
FIG. 2 shows on a larger scale and in perspective one of the two releasing devices of the life boat according to FIG. 1.

The displacement of the lifting means 13 can be provided in many ways. A very simple way is shown in FIG. 2, according to which the lifting means 13 is pivotably mounted in a lever arm 25. One end 26 of the lever arm 26 is pivoted about an axle 27 in the bracket 14, while the other end 28 acts upon a locking device 29, which prevents an involuntary release. According to this embodiment the locking device 29 consists of a steel cable 30, one end of which is attached to the bracket 14 of the releasing device and which is passed over a pulley wheel at the end 28 of the lever arm and further to a second pulley wheel and over to the other end of the boat where it is attached in the corresponding bracket 14 for the other releasing device. The locking device 29, i.e. the wire 30 can be released by simply cutting the wire off. For this purpose there should be an appropriate pliers (not shown) available in the boat, which is mounted on a bracket, which can be swung over the wire for cutting it off.

Figures 3, 4:
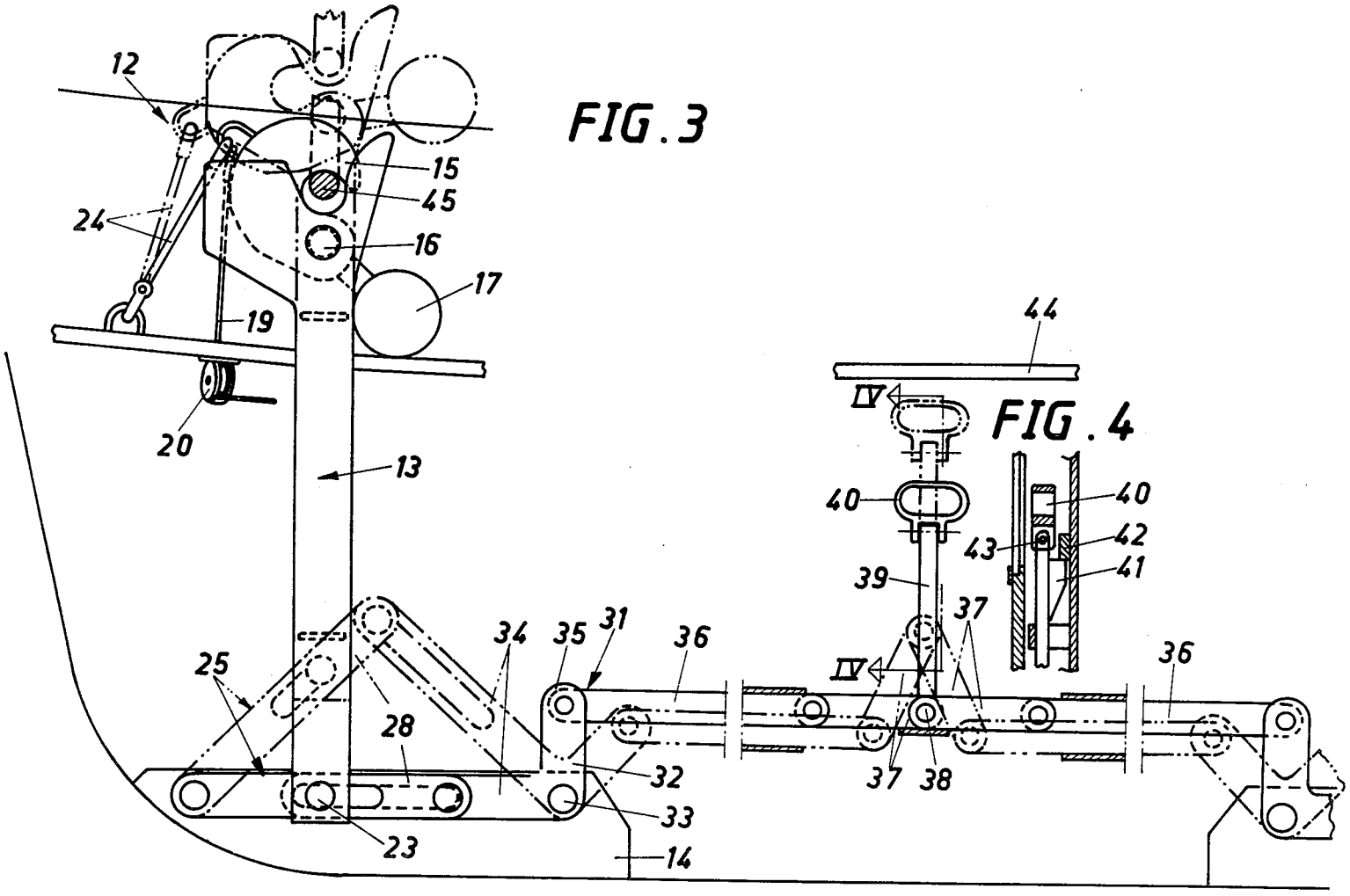
FIG. 3 is a side view partly in section of a modified embodiment of the releasing device.
FIG. 4 is a section according to the line IV—IV in FIG. 3.

Another possible embodiment of the emergency releasing device is shown in FIG. 3. According to this embodiment the wire 30 has been replaced by a linkage 31 comprising a joint lever 32, which is pivotably mounted to the bracket 14 about an axle 33. One arm 34 of the joint lever is pivotably connected to the end 28 of the lever arm 25, while the other arm 35 is pivotably mounted to a rod 36. In the same way as in the previous embodiment the rods 36 of both releasing devices are connected to each other by way of two links 37, at which a push rod 39 is arranged at their joint 38, a handle 40 being pivotably attached to the opposite end of said push rod 39.

In the position shown with continuous lines in FIG. 3 the releasing device is blocked, at which a shoulder 41 on the push rod 39 rests against a stop 42. As can be seen in FIG. 1 the handle 40 is preferably placed in a recess below the side bench 44 behind a glass which is broken when an emergency situation occurs, which requires an emergency release of the releasing device. By drawing the handle forwards it will pivot about an axle 43, at which the back portion of the handle will press against the stop 42 so that the shoulder 41 can pass it. By that the compressive force acting upon the lifting means 13, the lever arms 25 and 35 and the rods 36 and 37 will press the rod 39 upwards so that the lifting means can be displaced in the drawing direction of the winding-tackles of the life boat so much that the hooks release the hoisting cables 45 or the blocks with lifting loops supported thereby. This position is shown with dash-dotted lines in FIG. 3.

The advantage of this somewhat more complicated embodiment is that this construction does not comprise any wires which can stretch and that the emergency releasing device can be tested without any destruction of material.

Figure 5:
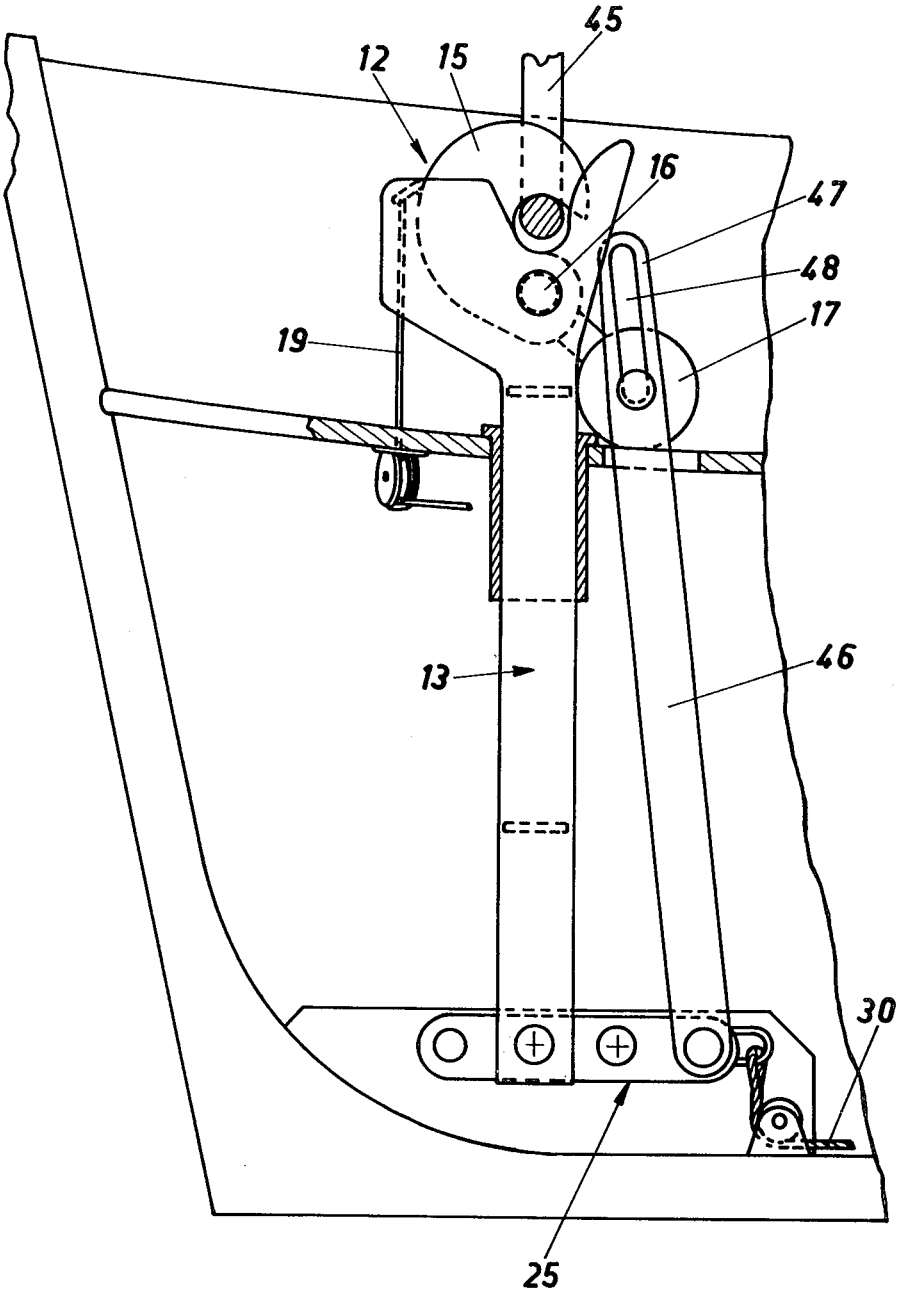
FIG. 5 is a side view partly in section of a further embodiment of the releasing device.

The modified embodiment shown in FIG. 5 differs from the one shown in FIG. 2 by the fact that the blocking member 24 has been replaced by a link 46, one end of which is pivotably connected to the weight 17 of the hook 15. For enabling the release of the releasing means in the usual way by means of the wire 19 and the handle 20, the link 46 is provided with an extension 47 with an oblong hole 48, so that the hook 15 can make a swinging movement without actuating the emergency release mechanism.

The invention is not limited to the embodiments described above and shown in the drawings but a plurality of modifications can be made within the scope of the claims.

What I claim is:

1. A device for releasing a life boat or the like from a hoisting cable, comprising a lifting means having a lower end thereof fastened to the boat, a hook for the hoisting cable pivotally mounted on said lifting means and movable between open and closed positions, a releasing device for moving said hook to the open position, said lifting means being limitedly displaceable towards the hoisting cable by a pulling force from the hoisting cable and having a substantial length in a vertical direction to provide a guide for the lifting means during the entire displacement thereof, a locking device for preventing the displacement of said lifting means, and an emergency releasing device comprising a blocking means connected to the hook and arranged eccentrically with respect to the pivot axis of the hook, said blocking means being arranged to pivot the hook to the open position upon displacement of the lifting means towards the hoisting cable when said locking device is released.

2. A device according to claim 1, wherein said emergency releasing device comprises a lever arm having one end pivotably mounted on the boat and the other end operably connected to the locking device, the lower end of said lifting means being pivotably attached to the lever arm.

3. A device according to claim 2, wherein the locking device comprises a releasable member.

4. A device according to claim 2, wherein the locking device comprises an extensible member.

5. A device according to claim 2 or 3, wherein there is provided an emergency releasing device in the fore and aft of the boat connected by said locking device.

6. A device according to claim 2 or 3, wherein the locking device comprises a wire which can be cut by a cutting member.

7. A device according to claim 1, wherein the blocking means comprises a wire which is fixed to the boat.

8. A device according to claim 2, wherein the blocking means comprises a link having one end pivotably mounted at the other end of the lever arm, the other end of said link being pivotably connected to a weight or the like connected to the hook.

* * * * *